US007337610B2

(12) United States Patent
Bitter

(10) Patent No.: US 7,337,610 B2
(45) Date of Patent: Mar. 4, 2008

(54) HYDRAULIC ARRANGEMENT

(75) Inventor: Marcus Bitter, Mannheim (DE)

(73) Assignee: Deere & Company, Moline, IL (US)

( * ) Notice: Subject to any disclaimer, the term of this patent is extended or adjusted under 35 U.S.C. 154(b) by 57 days.

(21) Appl. No.: 11/471,137

(22) Filed: Jun. 20, 2006

(65) Prior Publication Data

US 2007/0033933 A1 Feb. 15, 2007

(30) Foreign Application Priority Data

Aug. 11, 2005 (DE) ..... 10 2005 038 333

(51) Int. Cl.
*F15B 11/02* (2006.01)
*B66F 9/00* (2006.01)
*E02F 9/00* (2006.01)

(52) U.S. Cl. ..... 60/469; 60/413

(58) Field of Classification Search ..... 60/413, 60/467, 469; 91/420
See application file for complete search history.

(56) References Cited

U.S. PATENT DOCUMENTS 4,995,517 A * 2/1991 Saotome ..... 60/413
6,357,230 B1 * 3/2002 A'Hearn et al. ..... 60/413
6,370,874 B1 * 4/2002 Rausch et al. ..... 60/413
6,988,363 B2 * 1/2006 Bitter ..... 60/469
7,140,178 B2 * 11/2006 Bitter ..... 60/413
7,204,086 B2 * 4/2007 Cook et al. ..... 60/469

FOREIGN PATENT DOCUMENTS

DE 197 54 828 C2 10/1999
DE 101 33 616 A1 1/2003
DE 103 30 344 A1 2/2005
EP 0 381 788 B1 10/1994
EP 1 157 963 A2 11/2001
JP 08302753 A 11/1996

* cited by examiner

*Primary Examiner*—Thomas E. Lazo

(57) ABSTRACT

A hydraulic arrangement is provided for a spring support system. The hydraulic circuit arrangement includes a hydraulic cylinder, a hydraulic tank, a hydraulic conveying device, a hydraulic accumulator, a first selector valve arranged between the hydraulic accumulator and the hydraulic cylinder, a control implement with at least three switch positions, that include a lifting position, a lowering position and a neutral position for the hydraulic cylinder and a pipe break safety arrangement arranged between the control implement and the hydraulic cylinder. In order to permit the opening of the pipe break safety arrangement, a first control pressure line extends between the pipe break safety arrangement and a conveying device and first switching devices are arranged in the first control pressure line so that a control pressure can be applied to the first control pressure line by switching the first switching devices and the pipe break safety arrangement can be controlled to open.

18 Claims, 3 Drawing Sheets

HYDRAULIC ARRANGEMENT

FIELD OF THE INVENTION

The present invention concerns a hydraulic arrangement for a spring support system, with a hydraulic cylinder provided with at least one first chamber, a hydraulic tank, at least one conveying device conveying hydraulic fluid, a hydraulic accumulator, a first hydraulic line arranged between the hydraulic accumulator and the first chamber, a first selector valve arranged in the first hydraulic line, a first supply line for the first chamber, a control implement with at least three control positions that include a lifting position, a lowering position and a neutral position for the hydraulic cylinder and a pipe break safety arrangement arranged in the first hydraulic line that includes a check valve closing in the direction of the control implement and a pressure relief valve that can be controlled by a first control pressure line.

BACKGROUND OF THE INVENTION

In agricultural machines such as, for example, telescopic loaders, wheel loaders or front loaders on tractors, it is common practice to apply a hydraulic spring support system that provides spring support for the boom or the oscillating crane in order to attain an improved total spring support comfort on the vehicle, particularly during operation. Here the lifting side of a hydraulic cylinder is connected to a hydraulic accumulator in order to attain a spring support through the hydraulic accumulator. Moreover the lowering side of the hydraulic cylinder is connected to a hydraulic tank in order, on the one hand, to avoid cavitation on the lowering side of the hydraulic cylinder and on the other hand to permit a free movement of the piston rod during the spring support process. To increase the safety against a sudden sinking of the boom or the oscillating crane these spring support systems are equipped with load holding valves or pipe break safety arrangements to insure the hydraulic cylinder against breaks in the hoses. However, then it is necessary for the lowering of the hydraulic cylinder to close the tank connection on the lowering side of the hydraulic cylinder, so that a necessary pressure can be built up to open the load holding valve. Only when the load holding valve is opened, can hydraulic fluid drain out of the lifting side of the hydraulic cylinder.

In EP 1157963 A2 a spring support system for the boom of a telescopic loader is disclosed that provides a load holding valve or a pipe break safety arrangement to secure the boom against a lowering. In order to effect, on the one hand, a pressure controlled lowering of the boom that requires an opening of the load holding valve and, on the other hand, to provide a spring support function even in the neutral position of the hydraulic cylinder, a separate selector valve is arranged. A pressure relief valve is provided for the opening of the load holding valve that can be controlled via a control pressure line of the supply line of the lowering side. In order to open the load holding valve the separate selector valve must then be closed, so that the supply line to the tank is closed and the pressure needed to open the load holding valve can build up in the supply line. The disadvantage here is that the pressure necessary to open the relief valve requires relatively high hydraulic power that must be provided each time the hydraulic cylinder is lowered under pressure. Moreover when the spring support is activated precise positioning during the lowering of the boom is made more difficult since the opening pressure on the lowering side of the hydraulic cylinder also indirectly leads to a hydraulic loading of the hydraulic accumulator which is subsequently unloaded, and is, in turn connected with a movement of the hydraulic cylinder.

Accordingly there is a clear need in the art to improve a spring support system of the aforementioned type in such a way that a lowering of the hydraulic cylinder under pressure can be performed with lower hydraulic power and a more precise positioning of the boom becomes possible when this spring support system is activated.

SUMMARY OF THE INVENTION

According to the invention a hydraulic circuit arrangement of the aforementioned type is configured in such a way that the first control pressure line extends between the pipe break safety arrangement and a conveying device and that switching devices are arranged in the first control pressure line so that by switching the switching devices, pressure is applied to the first control pressure line and the pressure relief valve can be controlled. Preferably the pipe break safety arrangement includes a check valve that closes in the direction of the control implement and is arranged in a bypass line that bypasses the pressure relief valve. The pressure can be controlled upward in the pressure relief valve by means of an over-pressure line from the first supply line or over the first control pressure line which is supplied by a control pressure generated by a pressure generating conveying device. The conveying device that generates control pressure can be used for the usual supply of the hydraulic cylinder or a separate conveying device may be applied. Since the relief valve is provided with a first control pressure line that is not connected to the supply line of the hydraulic cylinder, the relief valve can be actuated, that is, controlled with pressure, independently of the pressure existing in the hydraulic cylinder. The separate pressure loading of the first pressure control line independent of the second chamber of the hydraulic cylinder permits an upward control of the pressure relief valve at relatively low hydraulic pressure, so that a pressure loaded lowering of the hydraulic cylinder can be performed at lower hydraulic power, or even without any pressure applied to the second chamber of the hydraulic cylinder, for example, by means of the force of gravity of a boom actuated by the hydraulic cylinder. Thereby the hydraulic circuit arrangement according to the invention can also be applied to a hydraulic spring support system for a single acting hydraulic cylinder. Moreover when the hydraulic spring support is activated, that is, when the hydraulic accumulator is switched into the hydraulic circuit arrangement, a more precise positioning of the boom is made possible, since the control pressure generated to open the pressure relief valve is not built up over a second chamber and hence the pressure applied to the hydraulic accumulator is considerably lower, so that the spring deflection movement of the hydraulic cylinder (as it affects the hydraulic accumulator) is considerably less during the lowering. Due to the reduced hydraulic power requirement an advantage is gained, not at least in the power demand, since, for example, even at low conveying power the boom can be lowered at maximum velocity.

The hydraulic circuit arrangement is provided with coupling devices, that couple the first switching device with the control implement in such a way that a switch position of the first switching device, in which a pressure is applied to the first control pressure line, occurs in synchronism with the lowering position of the control implement. This provides the assurance that the pressure relief valve opens as soon as the control implement is switched into a lowering position and that the hydraulic fluid located in the first chamber can drain off during the lowering of the hydraulic cylinder.

Preferably the control implement can be switched hydraulically and is also switched by means of control pressure lines. Then the coupling devices can be configured as a second control pressure line extending between the first control pressure line and the control implement, so that a pressure applied to the second control pressure line results in the application of pressure to the first control pressure line. Since the first control pressure line is connected over the second control pressure line to the control implement, the first switching devices are coupled to the control implement, so that the control pressure generated for the control of the pressure relief valve is simultaneously the pressure generated for switching the control implement into the lowering position. By switching the first switching device for the control of the pressure relief valve upward the control implement is simultaneously retained in the lowering position.

The control implement that can be switched hydraulically is preferably provided with a third control pressure line through which it can be switched into the lifting position. For this purpose two switching devices are provided in the third control pressure line through which pressure can be applied to the third control pressure line.

Preferably the switching devices are configured as proportional switch valves, particularly pressure reducing valves through which a connection of the control pressure lines to the hydraulic tank or to a conveying device can be established selectively, where the switching devices may be actuated or controlled mechanically, electrically, hydraulically or pneumatically and can be switched or moved in proportion to a control signal from a preferably closed first switch position into an open second switch position. Here the second switch position can be varied or controlled in proportion to the control signal so that a pressure reduction can be performed in proportion to the control signal.

In particular, the switching devices can also be configured as a hydraulic actuating arrangement in the form of a joystick, where simultaneously a hydraulic supply of the first and the second control pressure lines is established, as soon as the joystick is moved into a position provided for the lowering position of the control implement. By moving the joystick into a position provided for the lifting position of the control implement pressure is applied to the third control pressure line of the control implement and simultaneously the hydraulic supply for the first and the second control pressure lines is interrupted. By moving the joystick into a position provided for the neutral position of the control implement, the hydraulic supply for the first, second and third control pressure lines is interrupted, so that the control implement can assume the neutral position, for example, by preloaded adjustment springs.

In an alternative embodiment the coupling devices include an actuating arrangement for the first switching devices. The switching devices are brought into an open position or a closed position as a function of the switch position of the control implement. Depending on the configuration of the control implement, it is possible here to omit the third control pressure line, for example, in the case of an electrically or hydraulically switched control implement, so that only the switching devices for the first control pressure line need to be actuated. The actuating arrangement for the first switching devices may, for example, be mechanical, by means of a key/plunger combination or it may be configured electrically, for example, by means of a switch or a sensor. In that way, for example, an angle sensor or a position sensor could be used that detects the switch position of the control implement or the hydraulic actuating arrangement or the position of a joystick and generates a signal for the switching of the first switching device. Moreover other actuating arrangements could be considered that would be appropriate for anyone skilled in the art of hydraulic controls and have the effect that the first switching devices are switched automatically and in synchronism with the control implement in such a way that when the control implement is switched into the lowering position a pressure is supplied to the first control pressure line in order to open the pressure relief valve of the pipe break safety arrangement.

In a further embodiment the control implement is configured as the slide of a slide valve that is provided with three switch positions each of which has two inlets and two outlets. In the individual positions the supply lines are connected to either the conveying device or to the hydraulic tank or closed as a function of the switch positions (lifting, lowering and neutral or stopping). Simultaneously the first switching devices are switched by means of the actuating arrangements as a function of the switch positions of the control implement. For this purpose, for example, the slide of the slide valve may be connected to a switching device, such as a key, a positioning arm, a positioning lever, a positioning slide or the like, that actuates an actuating plunger or a switch. The switching device may also be connected, for example, by means of a rope pull to the valve slide, through which, by moving the valve slide, the switching device is moved out of a preloaded position (for example, retained by an adjusting spring). Here it must be stressed again that the control implement may be configured as a mechanically, electrically or hydraulically actuated control implement, where the valve slide may be moved in known manner mechanically, electrically or hydraulically.

As already noted above a hydraulic circuit arrangement, according to the invention, with spring support function can be applied to great advantage to a single-acting hydraulic cylinder, that is, a hydraulic cylinder with only one pressure chamber as well as to a double-acting hydraulic cylinder, that is, a hydraulic cylinder with two pressure chambers.

In that way the hydraulic cylinder may be provided with a second chamber, that is supplied by a second supply line. Preferably a second hydraulic line is then arranged between the second chamber and the hydraulic tank. During a lifting movement of the hydraulic cylinder the hydraulic fluid located in the second chamber can drain off into the hydraulic tank.

Moreover the hydraulic circuit arrangement can be provided with a second switched valve that is arranged in the second hydraulic line. The second switching valve can be used to close the second hydraulic line to the tank, so that pressure can be applied to the second chamber from the control implement when the spring support function is activated as well as when it is not activated. This is advantageous in case a contact pressure is needed for an operating tool fastened to a boom actuated by the hydraulic cylinder or in case the hydraulic cylinder or the boom is to be lowered under pressure. The first and the second selector valve are preferably provided with a closed position and an open position, where the first and the second selector valve can close in one or both closing directions, but can open in both closing directions in the open position, so that a spring support function can result in connection with the hydraulic accumulator or the hydraulic tank. The first and the second selector valve can be configured in such a way that they close in the closing position only in the direction of the hydraulic accumulator or the hydraulic tank. The first and the second selector valve are preferably actuated electrically. Obviously it is also conceivable that other methods of actuation can be applied to the first and second selector valve, for example, a manual, pneumatic or hydraulic actuation.

A hydraulic circuit arrangement according to the invention with a spring support function is appropriate, for example, for the lifting and lowering of a boom of a loader, for example, a wheel loader, front loader or a crane or telescopic loader, where such loader implements are applied in agriculture, construction or even in forestry.

If the spring function is now to be activated, that can be performed by means of a switch that is actuated by an operator in the cab of the loader implement, or, for example, by a speed signal, then the first and the second selector valve are brought into their open positions, in order to connect the first chamber of the hydraulic cylinder with the hydraulic accumulator and the second chamber of the hydraulic cylinder with the hydraulic tank. During an excitation by the running gear of the operating machine shock-like accelerations due to the free swinging of the boom or the oscillating crane can be damped so that an increase in the operating comfort can be attained. If a boom or a loader oscillating crane is lowered with a non-activated or activated spring support, then control pressure is automatically applied to the first control pressure line so that the pipe break safety arrangement or the pressure relief valve is opened, which is necessary for the lowering of the boom or the oscillating crane. Here it is not necessary to close the second selector valve since the control pressure required during the lowering of the boom for the opening of the pressure relief valve is not built up above the pressure in the second chamber. During the lowering a security against breaks of the hoses of the hydraulic arrangement is assured, since the hydraulic fluid drains off at all times under control over the pressure relief valve. If the boom or the oscillating crane is lifted with the lifting position of the control implement with the spring support arrangement in active position then the second chamber of the hydraulic cylinder is automatically connected to the hydraulic tank so that the hydraulic fluid displaced by the lifting process can drain into the hydraulic tank. If during the lifting or lowering process a jolt is transmitted to the boom or the oscillating crane then the spring support can deflect without danger of cavitation when any pressure in the second chamber is released of to the tank.

To acquaint persons skilled in the art most closely related to the present invention, one preferred embodiment of the invention that illustrates the best mode now contemplated for putting the invention into practice is described herein by and with reference to, the annexed drawings that form a part of the specification. The exemplary embodiment is described in detail without attempting to show all of the various forms and modifications in which the invention might be embodied. As such, the embodiment shown and described herein is illustrative, and as will become apparent to those skilled in the art, can be modified in numerous ways within the spirit and scope of the invention—the invention being measured by the appended claims and not by the details of the specification.

BRIEF DESCRIPTION OF THE DRAWINGS

For a complete understanding of the objects, techniques, and structure of the invention reference should be made to the following detailed description and accompanying drawings, wherein.

DESCRIPTION OF THE PREFERRED EMBODIMENT

Figure 1:
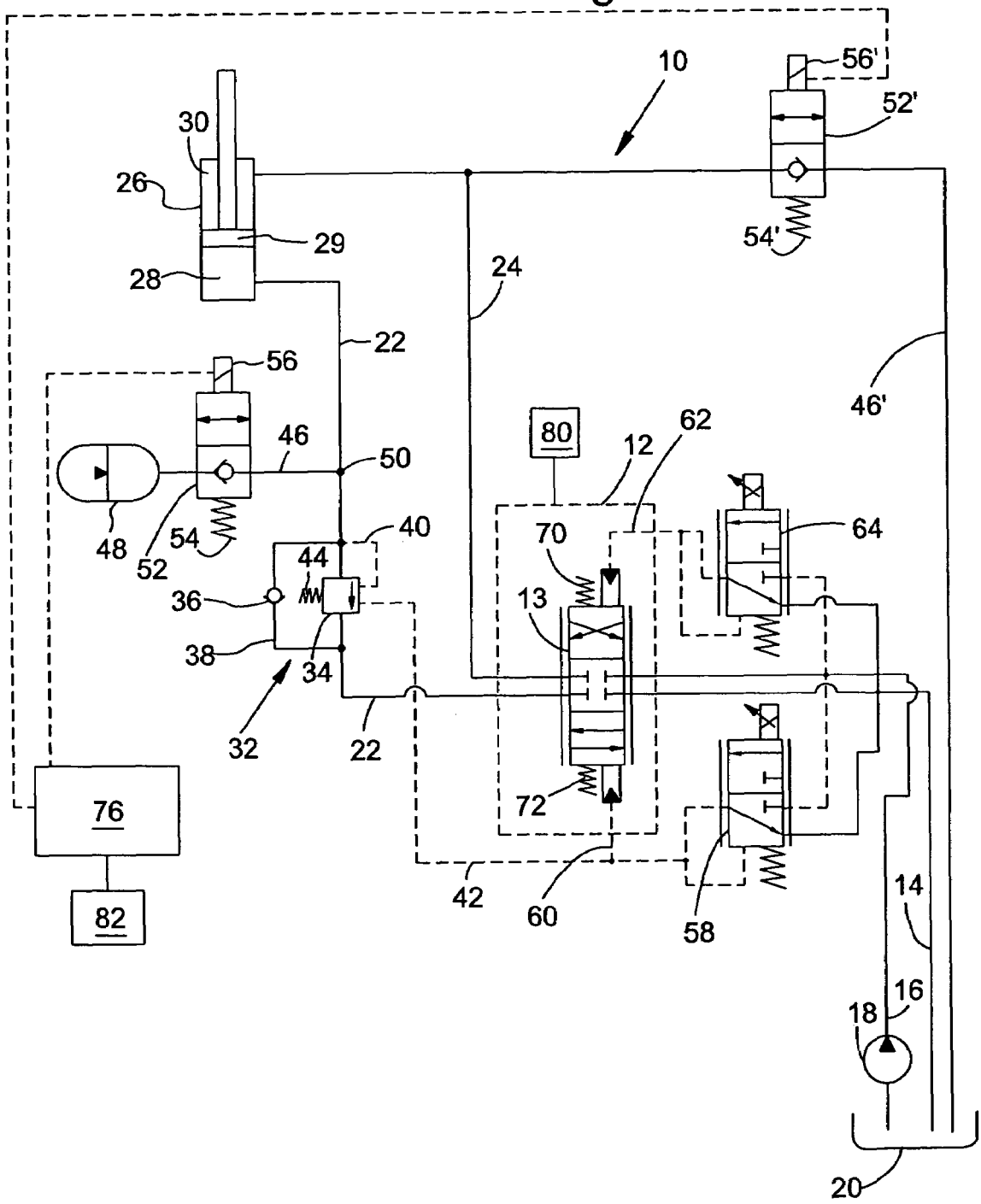
FIG. 1 shows a hydraulic circuit arrangement of a hydraulic arrangement according to the invention for a spring support system of a hydraulic cylinder.

A hydraulic circuit arrangement 10 shown in FIG. 1 shows an embodiment according to the invention to achieve a spring support system. The hydraulic circuit arrangement 10 includes a control implement 12 that can be shifted hydraulically and that is configured, for example, as a slide valve with a valve slide 13 and is connected by means of hydraulic lines 14, 16 to a pump 18 and a hydraulic tank 20, where the control implement 12 can be switched into three operating positions i.e. a lifting position, a lowering position and a neutral position.

The control implement 12 is connected to a hydraulic cylinder 26 over a first and a second supply line 22, 24, where the first supply line 22 leads into a first chamber 28 of the hydraulic cylinder 26 and the second supply line 24 leads into a second chamber 30 of the hydraulic cylinder 26. A piston 29 separates the two chambers 28, 30 from each other. The first chamber 28 of the hydraulic cylinder 26 represents the piston side or the lifting side chamber whereas the second chamber 30 represents the rod side or lowering side chamber of the hydraulic cylinder.

A load holding valve arrangement or a pipe break safety arrangement 32 is provided in the first supply line 22. The pipe break safety arrangement 32 includes a pressure and spring controlled pressure limiting valve or pressure relief valve 34, as well as a check valve 36 opening towards the hydraulic cylinder side that is arranged over a bypass line 38 parallel to the pressure relief valve 34. A pressure connection is established over an over-pressure line 40 from the pressure relief valve 34 to the section of the first supply line 22 on the side of the hydraulic cylinder. A pressure connection is established from the pressure relief valve 34 to the pump 18 over a first control pressure line 42. Moreover an adjusting spring 44 holds the pressure relief valve 34 in closed position.

A first hydraulic line 46 connects the first chamber 28 or the first supply line 22 with a hydraulic accumulator 48, where the end 50 of the first hydraulic line 46 not connected to the hydraulic accumulator 48 is arranged between the first chamber 28 and the pipe break safety arrangement 32.

A first selector valve 52 is arranged in the first hydraulic line 46. The first selector valve 52 represents an electrically controlled seat valve that is held in the closed position by an adjusting spring 54 and can be brought into an open position by a magnetic coil 56. The first selector valve 52 thereby seals in the closed position in the direction of the hydraulic accumulator 48. Here the first selector valve 52 can also be configured in such a way that it seals in both directions without any leakage. In order to establish a spring support function between the hydraulic cylinder 26 and the hydraulic accumulator 48 a flow of hydraulic fluid in both directions is guaranteed in the open position.

A second hydraulic line 46' connects the second chamber 30 or the second supply line 24 with the hydraulic tank 20.

A second selector valve 52' is arranged in the second hydraulic line 46'. The second selector valve 52' represents an electrically controlled seat valve that is held in the closed position by an adjusting spring 54' and can be brought into an open position by means of a magnetic coil 56'. At that point the second selector valve 52' seals in the closing position in the direction of the hydraulic tank 20. Here the second selector valve 52' may also be configured in such a way that it seals in both directions without any leakage. In order to establish a connection between the second chamber 30 of the hydraulic cylinder 26 and the hydraulic tank 20 in the open position a flow of hydraulic fluid is guaranteed in both directions.

A first switching device 58 configured as pressure reduction valve is provided in the first control pressure line 42, it provides a first switch position and at least a second switch position, where in the at least one second switch position a pressure reduction can be controlled continuously. The first switching device 58 is preferably controlled electronically where the first control pressure line 42 can be connected in the first switch position (as shown in FIG. 1) with the tank 20 and in the second switch position-with the pump 18.

Moreover the hydraulic circuit arrangement, according to the invention, is provided with a coupling device which couples or connects or synchronizes its switching process with the first switching device 58 with the control implement 12. The coupling device is configured in the form of a second control pressure line 60 that extends starting from the first control pressure line 42 to the control implement 12, so that when pressure is applied to the first control pressure line 42 pressure is also applied to the second control pressure line 60. The second control pressure line 60 is arranged in such a way that when pressure is applied the control implement 12 or the valve slide 13 are shifted or moved into the lowering position.

Moreover the control implement 12 is provided with a third control pressure line 62. A second switching device 64 is arranged in the third control pressure line 62 configured as a pressure reduction valve, this is provided with a first switch position and at least one second switch position, where in the second switch position a pressure reduction can be continuously controlled. The second switching device 64 is preferably switched electronically, where the third control pressure line 62 is connected to the tank 20 in the first switch position, as shown in FIG. 1, and is connected with the pump 18 in the second switch position. The third control pressure line 62 is arranged in such a way that when pressure is applied the control implement 12 or the valve slide 13 is switched or moved into the lifting position.

The individual operating conditions can now be controlled as follows over the control implement 12 as well as over the selector valves 52, 52'. As shown in FIG. 1, the control implement 12 is held in neutral position by adjusting springs 70, 72, where the first and the second switching devices 58, 64 are each in their first switching positions. The selector valves 52, 52' are in closed position. The first and/or second switching devices 58, 64 as well as the first and the second selector valves 52, 52' are switched by control signals by means of a joystick or by means of an electronic control arrangement 76. By actuating the electronic control arrangement 76 or a joystick (not shown) for the lifting, lowering or holding in the neutral position of the control implement 12, corresponding switching signals for the hydraulic cylinder 26 are generated for the first and the second switching devices 58, 64 so that the control implement 12 is brought out of the neutral position into the lifting or lowering position or out of the lifting or lowering position into the neutral position (holding position) by means of the electronic control arrangement 76 or by means of a joystick.

Figure 3:
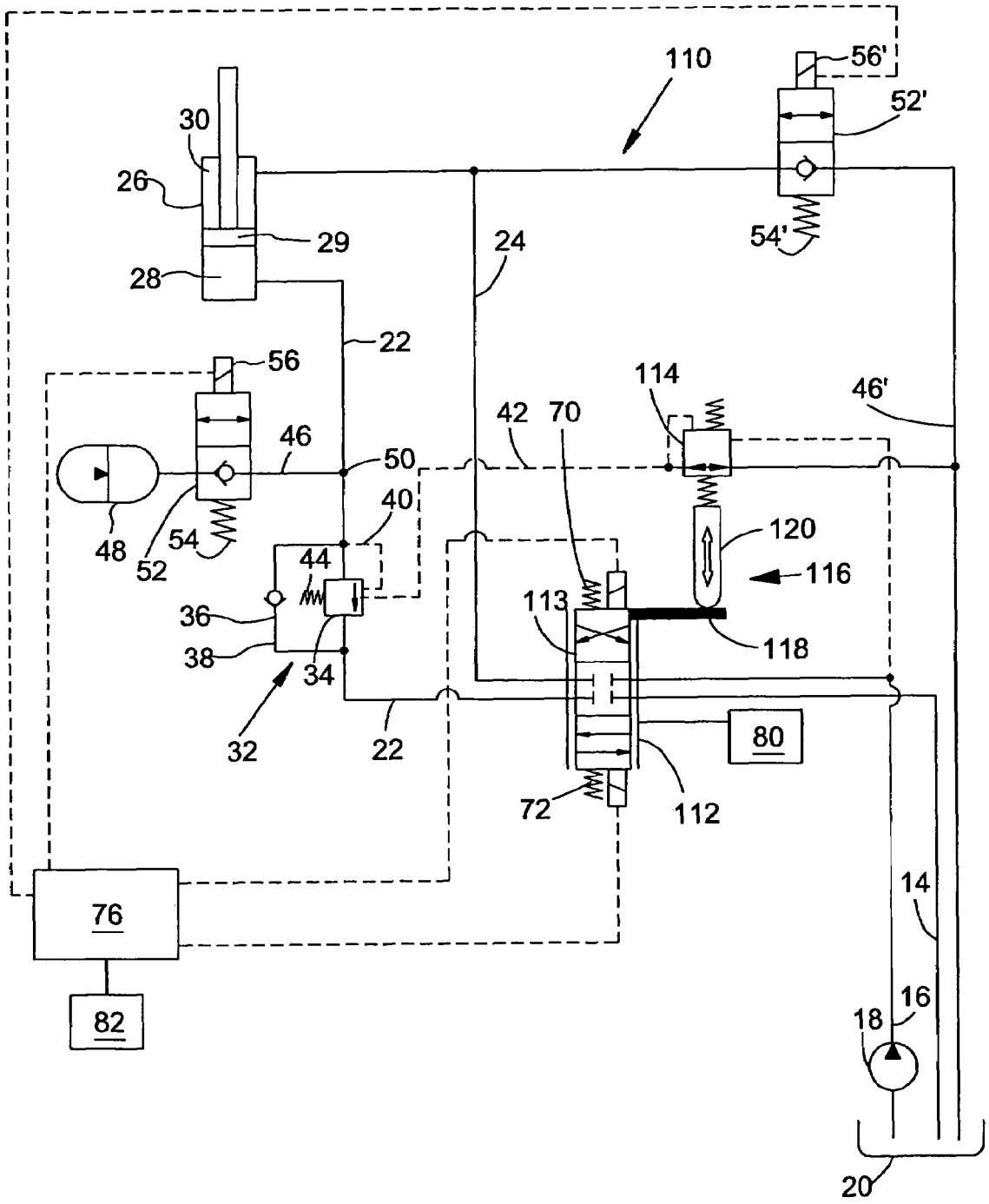

In the lifting position (the uppermost switch position of the control implement 12 in FIGS. 1 and 3) the connection of the first supply line 22 with the pump 18 and the connection of the second supply line 24 with the hydraulic tank 20 are established. For this purpose a corresponding control signal is generated by the control arrangement 76 whereby the second switching devices 64 are switched and a controlled pressure is applied to the third control pressure line 62 corresponding to the control signal. As a result the control implement 12 or the valve slide 13 is brought into the lifting position. Then the first chamber 28 of the hydraulic cylinder 26 is filled over the first supply line 22 and over the check valve 36 of the pipe break safety arrangement 32 (the pressure relief valve 34 of the load holding arrangement 32 is in the closed position). As a result the piston 29 moves in the direction of the second chamber 30 and forces the hydraulic fluid located there through the second supply line 24 into the hydraulic tank 20. By actuating the control arrangement 76 a corresponding control signal can be generated in order to shift into the neutral position (stop position), whereby the second switching devices 64 are again moved into their first switch position, a pressure release of the third control pressure line 62 to the tank is performed and the control implement 12 now occupies the neutral position (stop position). Simultaneously the control implement 12 suppresses the connections to the pump 18 and the hydraulic tank 20, so that the pressure in the two chambers 28, 30 of the hydraulic cylinder 26 is maintained and the movement of the piston 29 is stopped. The piston 29 remains stationary or is held.

In the lowering position (the lowest switch position of the control implement 12 in FIGS. 1 and 3) the connection of the first supply line 22 with the tank 20 and the connection of the second supply line 24 with the pump 18 is established. For this purpose a corresponding control signal is generated by the control arrangement 76 whereby the first switching device 58 is switched and a pressure is applied to the first and the second control pressure lines 42, 60 that is controlled corresponding to the control signal. As a result the control implement 12 or the valve slide 13 is brought into the lowering position. Then the second chamber 30 of the hydraulic cylinder 26 is filled over the second supply line 24. The pressure relief valve 34 is opened under the simultaneous application of pressure to the first control pressure line 42. As a result the piston 29 moves in the direction of the first chamber 28 and forces the hydraulic fluid located there over the opened pressure relief valve 34 through the second supply line 22 out into the hydraulic tank 20. By actuating the control arrangement 76 a corresponding control signal can be generated for a switch into the neutral position (stop position), whereby the first switching device 58 is again moved into its first switch position, a pressure release of the first and the second control pressure line 42, 60 to the tank is performed and the control implement 12 occupies the neutral position (stop position). Simultaneously the control implement 12 interrupts the connections to the pump 18 and to the hydraulic tank 20 so that the pressure in the two chambers 28, 30 of the hydraulic cylinder 26 is maintained and the movement of the piston 29 ceases. The piston 29 remains stopped or is retained. The switching processes described above can obviously be performed not only from a lifting or lowering position into a neutral position but also directly from a lifting position into a lowering position or the reverse.

Thereby the pipe break safety arrangement 32 guarantees that the hydraulic cylinder 26 retains its position in the neutral position or that in lifting position and neutral position no hydraulic fluid can escape from the pressure loaded first chamber 28 and that in the lowering position the hydraulic fluid can drain off out of the first chamber 28 over the opened pressure relief valve 34. In order to guarantee this situation the pipe break safety arrangement 32 should or must meaningfully be arranged on the lifting side of the hydraulic cylinder 26 as shown, where the lifting side is the side of the hydraulic cylinder 26 in which a pressure is built up for the lifting of a load. In the embodiment shown here the lifting side is the first chamber 28 of the hydraulic cylinder 26, where the second chamber 30 could also be used as lifting side. The over-pressure line 40 represents an overload safety device, so that in case excessive operating pressures are reached in the first chamber 28 of the hydraulic cylinder 26, that could be brought about, for example, by excessive load, a limiting pressure is reached in the over-pressure line 40 which opens the pressure relief valve 34 in order to reduce the pressure.

The positions of the control implement 12 can be detected on the basis of a switch or a sensor 80 connected to the control implement 12 and a signal can be transmitted to the electronic control arrangement 76. The control arrangement 76 is connected to the first and the second selector valve 52, 52'. The activation of the spring support is performed by means of an activation switch 82 that transmits an activation signal to the control arrangement 76.

As soon as an activation signal is transmitted the spring support is activated by means of the control arrangement 76 by opening the first and the second selector valve 52, 52'. As long as the first and the second selector valves 52, 52' are in the closed position, the hydraulic cylinder 26 is separated on the one side from the hydraulic accumulator 48 and on the other side from the hydraulic tank 20 and cannot perform any spring movements. Only by activation of the spring support arrangement, that is, by opening both selector valves 52, 52' or by switching the hydraulic accumulator 48 and the hydraulic tank 20 into the hydraulic circuit, the piston 29 can perform a spring movement, that is, it can move in both directions.

For a spring support function selected by the activation switch 82 the result is the following conditions corresponding to the various switch positions of the control implement 12.

In the lowering position (lowest switch position of the control implement in FIGS. 1 and 3) the first supply line 22 is connected to the hydraulic tank 20 and the second supply line 24 is connected to the pump. Simultaneously the pressure relief valve 34 is opened over the first control pressure line 42 so that hydraulic fluid can drain out of the first chamber 28 over the first supply line 22 into the hydraulic tank 20. Provision can be made for the electric control arrangement to bring the second selector valve 52' into a closed position as a function of a sensor signal of the sensor 80, that signals the lowering position, this brings the second selector valve 52' into a closed position, while this is not an absolute requirement for the lowering of the hydraulic cylinder, this may nevertheless be advantageous if the most rapid pressure supported lowering of the hydraulic cylinder is desired or if a contacting pressure is to be generated by the hydraulic cylinder, for example, if an operating tool fastened to one of the booms moved by the hydraulic cylinder is to be forced against the ground. If the second selector valve 52' should be closed then it is opened with the spring support activated, as soon as the control implement 12 is again brought out of the lowering position into the neutral or lifting position.

In the neutral position (center switch position of the control implement 12 in FIGS. 1 and 3) all inlets and outlets of the control implement 12 are closed, that is, no hydraulic fluid can flow through the supply lines 22, 24 to the control implement 12. Upon a spring support movement of the piston 29 the latter can move freely in both directions, since, on the one hand, the hydraulic fluid can flow out of the first chamber 28 over the open first selector valve 52 into the hydraulic accumulator 48 and (on the other hand) out of the second chamber 30 into the hydraulic tank 20 over the open second selector valve 52'.

In the lifting position (upper switch position of the control implement 12 in FIGS. 1 and 3) the first supply line 22 is connected to the pump 18 and the second supply line 24 connected to the hydraulic tank 20. A corresponding pressure is built up in the first supply line 22 or in the first chamber 28 by means of which the piston 29 is raised, so that hydraulic fluid can drain out of the second chamber 30 into the hydraulic tank 20 over the second supply line 24. Simultaneously the piston 29 can perform spring support movements since a connection has been established on the lifting side to the hydraulic accumulator 48 and on the lowering side to the hydraulic tank 20.

When the spring support function is activated the piston 29 can freely deflect as on a spring. If it moves downward due to a bump transmitted to it, hydraulic fluid is forced out of the first chamber 28 into the hydraulic accumulator 48. The pressure that is building up in the hydraulic accumulator 48 permits the hydraulic fluid to flow again back into the first chamber 28, so that the piston 29 moves upward again. This spring support movement is repeated, if necessary, until the bump has been fully compensated.

Figure 2:
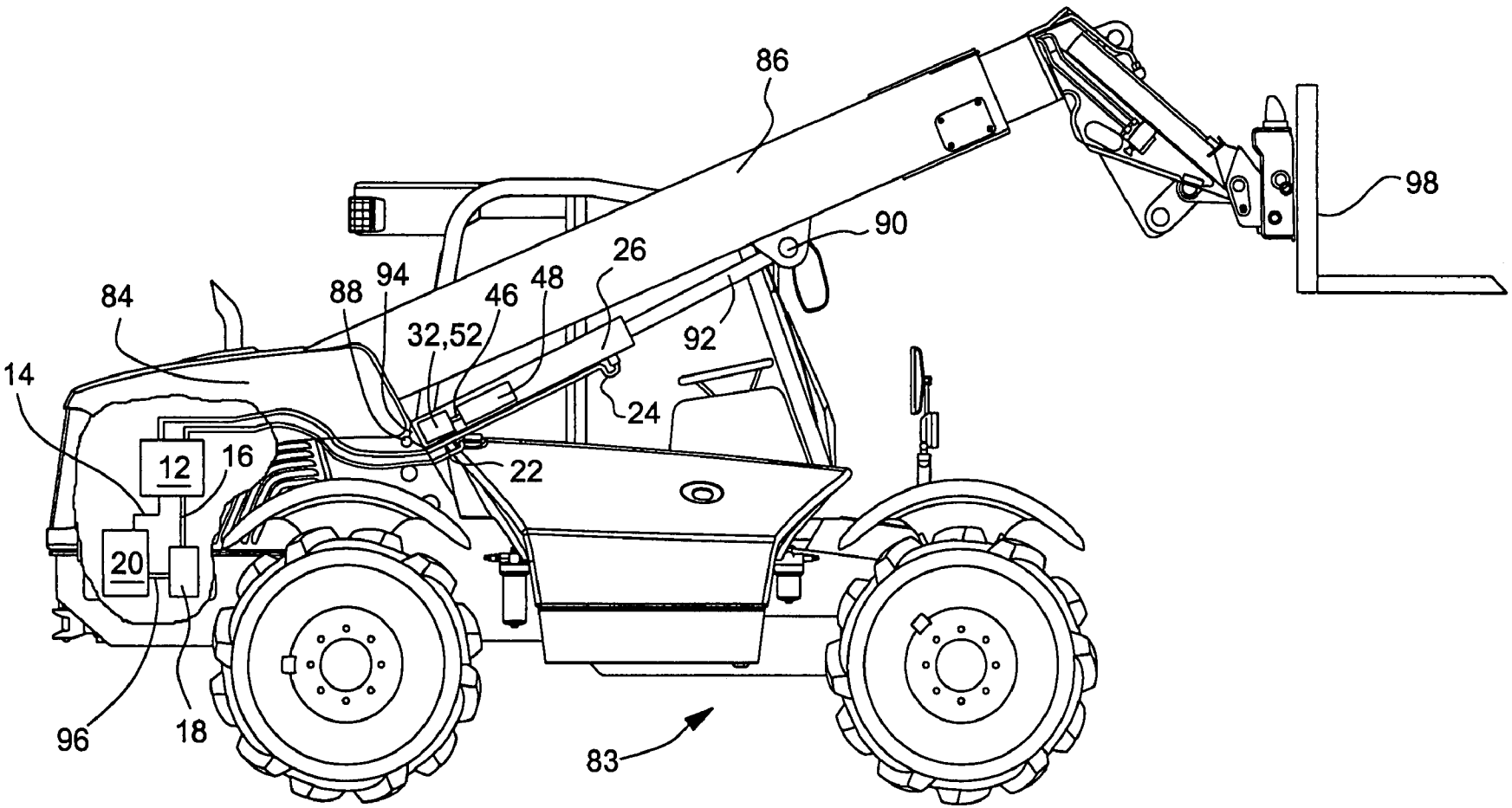
FIG. 2 shows a schematic view of a telescopic loader with a hydraulic arrangement according to the invention; and, FIG. 3 shows a hydraulic circuit arrangement of an alternative embodiment of a hydraulic arrangement, according to the invention, for a spring support system of a hydraulic system.

An application of the embodiment shown in FIG. 1 is made clear in FIG. 2. FIG. 2 shows a self-propelled telescopic loader 83 with a boom 86 pivoted from a housing 84 or frame of the telescopic loader 83 that can be extended telescopically. A hydraulic cylinder 26 is arranged between the boom 86 and the housing 84 for the lifting and lowering of the boom 86. Here the hydraulic cylinder 26 is connected in joints to a first and a second bearing location 88, 90, free to pivot, where the piston rod side 92 is connected in joints to the second bearing location 90 at the boom 86 and the piston side 94 is connected in joints to the first bearing location 88 at the housing 84. Moreover the hydraulic tank 20, the pump 18 and the control implement 12 are positioned at or in the housing 84 and are connected to each other by hydraulic lines 14, 16, 96. Moreover the supply lines 22, 24 between the control implement 12 and the hydraulic cylinder 26 can be seen in FIG. 2. The pipe break safety arrangement 32 as well as the selector valve 52 are located in a common valve block directly at the hydraulic cylinder 26. The hydraulic accumulator 48 is preferably also arranged at the hydraulic cylinder 26, so that the first hydraulic line 46 can be configured as a rigid connection between the common valve block and the hydraulic accumulator 48, which does not require a separate pipe break safety arrangement. The hydraulic cylinder 26 can be actuated in such a way, corresponding to the switch positions described above, that the boom 86 can be raised, held and lowered and, if necessary, can perform spring supported movements. When the spring support is activated the system guarantees that during an excitation, for example, from the running gear of the telescopic loader 82, bump-like accelerations due to the free swinging of the boom 86 are damped, resulting in an increase of the operating comfort, particularly when loads are accepted by an operating tool 98 and processed.

FIG. 3 shows an alternative embodiment that, in contrast to the embodiment shown in FIG. 1, is provided with an electronically actuated or switched control implement 112, where the control implement 112 also includes a slide valve with a valve slide 113. But here the control implement 112 can also be configured as a hydraulically or mechanically controlled control implement. Here the control implement can also be actuated by an electronic control arrangement 76 or by means of a joystick or a similar control arrangement. Moreover the hydraulic arrangement 110 described here corresponds to the arrangement 10 that is shown in FIG. 1 and described above, as long as corresponding differences are not pointed out. The hydraulic arrangement 110 shown in FIG. 3 also includes a first control pressure line 42 that extends between the relief valve 34 of a pipe break safety arrangement 32 and a conveying device or pump 18. First switching devices 114 are also arranged in the first control pressure line 42, these are configured as selector valves, in particular pressure reduction valves. A significant difference to the embodiment shown in FIG. 1 consists of the fact that in FIG. 3 the first switching devices 58 of FIG. 1 are replaced by first switching devices 114 and that mechanical coupling devices are arranged between the first switching devices 114 and the control implement 112. The second switching devices 64 as well as the second and third control pressure lines 60, 62 (of FIG. 1) are eliminated, since the selector valve 112 is controlled electrically. But it is also conceivable that the control implement 112 be configured so as to be hydraulically controlled, corresponding to the control implement 12 shown in FIG. 1, and to provide the first and the second switching device 58, 64 necessary for the control of the control implement 12, without the first switching device 58 being combined with the control pressure line 42. The coupling devices are configured as mechanical actuating devices 116 for the first switching devices 114 where the actuating arrangements 116 bring the first switching devices 114 into a first or second switching position as a function of or proportional to the switch position of the control implement 112 or the valve slide 113, where in the second switch position a pressure reduction is performed in the first control pressure line proportional to the movement of the control implement 112 or the valve slide 113. In the first switch position a connection of the control pressure line 42 to the pump 18, is interrupted, in the second switch position a connection of the control pressure line 42 to the pump 18 is established, so that pressure is applied to the control pressure line 42. The relationship of the switch position of the control implement 112 or of the valve slide 113 is such that when the control implement 112 or the valve slide 113 is brought into the lowering position (lowest switch position of the control implement 112 in FIG. 3) the actuating arrangement 116 brings the first switching devices 114 into the second switch position, so that pressure is applied to the control pressure line 42 and the pressure relief valve 34 is opened. As soon as the control implement 112 or the valve slide 113 is again moved out of the lowering position, the first switching device 114 is again brought into the first switch position. The actuating arrangement 116 is provided with an positioning slide 118 that is in contact with an actuating plunger 120 arranged at the first switching device 114, or is brought into interaction with it. As soon as the control implement 112 or the valve slide 113 is moved into the lowering position, the actuating plunger 120 is moved into position or is actuated, whereby the first switching devices 114 are brought into the second switch position. As soon as the control implement 112 or the valve slide 113 is again moved out of the lowering position, the actuating plunger 120 is relieved of its load from the positioning slide 118 or it moves back again so that the first switching devices 114 again occupy their first switch position. By coupling the movement or the switching process of the control implement 112 or the valve slide 113, that is enforced by the actuation arrangement 116, a guarantee is thereby provided that, as soon as the hydraulic cylinder 26 assumes its lowering position, the pressure relief valve 34 is controlled so as to open synchronously and in proportion to the movement of the positioning slide, so that hydraulic fluid can drain off out of the first chamber 28 during the lowering of the piston 29. But simultaneously a pipe break safety function is assured. Moreover it is also conceivable that the actuating arrangement 116 be configured as an electric device. In that way, for example, the position of the control implement 112 or the valve slide 113 can be detected by the sensor 80. A signal proportional to that position can then be generated by the electronic control arrangement 76 and used for the control of the first switching devices 114, where the first switching devices 114 are configured as electronically controlled switching devices or pressure reducing valves.

Otherwise the functions described above are valid with respect to FIG. 1 are also valid for the alternative embodiment shown in FIG. 3.

The embodiment shown in FIG. 3 can also be applied to the telescopic loader 83 shown in FIG. 2 corresponding to the embodiment shown in FIG. 1.

Thanks to the arrangement according to the invention, the first control pressure line 42 provides the assurance that the pressure relief valve 34 of the pipe break safety arrangement 32, that was described on the basis of two embodiments in reference to FIGS. 1 and 3, provides the assurance that the boom can be lowered independently of a pressure existing in the second chamber, whereby an improved power utilization, particularly in regard to hydraulic power at the idle rotational speed of the telescopic loader 83, can be achieved. Moreover a more precise positioning can be achieved during the lowering of the boom with the spring support activated.

Emphasis is again placed on the fact that the first and the second switching devices 58, 114, 64 may be actuated or controlled mechanically, electrically, hydraulically or pneumatically, and can be switched or moved in proportion to a switch signal or control signal out of a preferably closed first switch position, into an open second switch position. Here the second switch position can be varied or controlled in proportion to the switch signal or control signal, so that a pressure reduction in proportion to the switch signal or control signal can be attained.

Moreover it must be emphasized again that the embodiments described above are based on an example of a double-acting hydraulic cylinder 26 that is provided with a first and a second chamber 28, 30 to which pressure can be applied. The hydraulic circuit arrangements 10, 110 shown in the embodiments can, nevertheless, be applied in a corresponding manner to a single-acting hydraulic cylinder 26, which is obvious to anyone skilled in the art, so that this will not be described in any further detail.

Although the invention has been described in terms of only two embodiments, anyone skilled in the art will perceive many varied alternatives, modifications and variations in the light of the above description as well as the drawing, all of which fall under the present invention. In that way, for example, the hydraulic circuit arrangement can also be applied to other vehicles, for example, to wheel loaders or front loaders or even to excavators or cranes, that are provided with hydraulically actuated components, that can be raised or lowered and in which a spring support appears meaningful.

Thus it can be seen that the objects of the invention have been satisfied by the structure presented above. While in accordance with the patent statutes, only the best mode and preferred embodiment of the invention has been presented and described in detail, it is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

The embodiments of the invention in which an exclusive property or privilege is claimed are defined as follows:

1. An improved hydraulic circuit arrangement for a spring support system having a hydraulic cylinder provided with at least one first chamber, a hydraulic tank, at least one conveying device conveying a hydraulic fluid, a hydraulic accumulator, a hydraulic line arranged between the hydraulic accumulator and the first chamber, a first selector valve arranged in the first hydraulic line, a first supply line for the first chamber, a control implement with at least three switch positions that include a lifting position, a lowering position and a neutral position for the hydraulic cylinder and a pipe break safety arrangement arranged in the first supply line that includes a check valve closing in the direction of the control implement and a pressure relief valve that can be controlled over a first control pressure line, wherein the improvement comprises:

the first control pressure line extending between the pipe break safety arrangement and a conveying device; and, the first switching devices are arranged in the first control pressure line, so that by switching the first switching devices a control pressure can be applied to the first control pressure line and the pressure relief valve can be controlled to open.

2. An improved hydraulic circuit arrangement according to claim 1, wherein coupling devices are provided that couple the first switching devices with the control implement in such a way that a switch position of the first switching devices, in which a pressure is applied to the first control pressure line, occurs synchronously to a lowering position of the control implement.

3. An improved hydraulic circuit arrangement according to claim 2, wherein the coupling devices include an actuation arrangement for the first switching devices that bring the first switching devices into a first or second switch position as a function of or proportional to the switch position of the control implement.

4. An improved hydraulic circuit arrangement according to claim 3, wherein the actuation arrangement includes an angle sensor or a position sensor.

5. An improved hydraulic circuit arrangement according to claim 3, wherein the control implement includes a valve slide and that the actuation arrangement includes a positioning slide connected to the valve slide and also includes an actuation plunger arranged on the first switching device, where the actuation plunger can be actuated from the positioning slide by moving the valve slide.

6. An improved hydraulic circuit arrangement according to claim 1, wherein the control implement can be controlled hydraulically and the coupling devices include a second control pressure line extending between the first control pressure line and the control implement so that pressure applied to the second control pressure line results in an application of pressure to the first control pressure line.

7. An improved hydraulic circuit arrangement according to claim 1, wherein the control implement includes a third control pressure line provided for the switching of the control implement into the lifting position, where two switching devices are arranged in the third control pressure line.

8. An improved hydraulic circuit arrangement according to claim 7, wherein the second switching devices include a proportional selector valve, in particular a pressure reduction valve through which a connection can be selectively established between the third control pressure line and the hydraulic tank or a conveying device.

9. An improved hydraulic circuit arrangement according to claim 7, wherein the second switching devices are configured as hydraulic joysticks, where a hydraulic supply of the third control pressure line can be established as soon as the second switching devices are moved into a position provided for the lifting position of the control implement.

10. An improved hydraulic circuit arrangement according to claim 1, wherein the first switching devices include a proportional selector valve in particular a pressure reduction valve through which a connection can selectively be established between the first control pressure line and the hydraulic tank or a conveying device.

11. An improved hydraulic circuit arrangement according to claim 1, wherein the switching devices can be actuated mechanically, electrically, hydraulically or pneumatically.

12. An improved hydraulic circuit arrangement according to claim 1, wherein the first switching devices are configured as hydraulic joysticks, where a hydraulic supply of the first and the second control pressure lines can be established as soon as the first switching devices are moved into a position provided for the lowering position of the control implement.

13. An improved hydraulic circuit arrangement according to claim 1, wherein the hydraulic cylinder is provided with a second chamber and a second supply line is provided for the second chamber and a second hydraulic line is arranged between the second chamber and the hydraulic tank.

14. An improved hydraulic circuit arrangement according to claim 13, wherein a second selector valve is provided and is arranged in the second hydraulic line.

15. An improved hydraulic circuit arrangement according to claim 14, wherein the second selector valve closes in the direction of the hydraulic tank when it is in the closing position.

16. An improved hydraulic circuit arrangement according to claim 14, wherein devices are provided that bring the second selector valve into a closed position when the control implement assumes a lowering position.

17. An improved hydraulic circuit arrangement according to claim 1, wherein the first and the second selector valve are provided with a closed position and an open position.

18. An improved hydraulic circuit arrangement according to claim 1, wherein the first selector valve closes in the closing position in the direction of the hydraulic accumulator.

* * * * *